US006987248B2

(12) United States Patent
Krieger et al.

(10) Patent No.: US 6,987,248 B2
(45) Date of Patent: Jan. 17, 2006

(54) MICROPROCESSOR CONTROLLED PORTABLE HEATING SYSTEM

(75) Inventors: Michael Krieger, Miami Beach, FL (US); Bruce Randolph, Ft. Lauderdale, FL (US)

(73) Assignee: Vector Products, Inc., Ft. Lauderdale, FL (US)

( * ) Notice: Subject to any disclaimer, the term of this patent is extended or adjusted under 35 U.S.C. 154(b) by 0 days.

(21) Appl. No.: 10/347,766

(22) Filed: Jan. 22, 2003

(65) Prior Publication Data

US 2003/0213794 A1 Nov. 20, 2003

Related U.S. Application Data

(60) Provisional application No. 60/379,762, filed on May 14, 2002.

(51) Int. Cl.
*H05B 1/02* (2006.01)

(52) U.S. Cl. ..... 219/494; 219/492; 219/497; 219/505; 323/236; 323/364

(58) Field of Classification Search ..... 219/494, 219/481, 492, 501, 209, 210, 506, 497, 499, 219/482; 331/69; 323/364, 234, 235, 236, 323/319

See application file for complete search history.

(56) References Cited

U.S. PATENT DOCUMENTS

| | | | | |
|---|---|---|---|---|
| 3,599,864 | A * | 8/1971 | Liddle | 219/492 |
| 4,631,728 | A * | 12/1986 | Simons | 372/38 |
| 5,041,800 | A * | 8/1991 | Long et al. | 331/69 |
| 5,626,783 | A * | 5/1997 | Lee et al. | 219/497 |
| 5,956,464 | A * | 9/1999 | Madni et al. | 395/61 |
| 5,986,241 | A * | 11/1999 | Funahashi | 219/497 |
| 6,084,216 | A * | 7/2000 | Slegt et al. | 219/497 |
| 6,380,521 | B1 * | 4/2002 | Fanzutti | 219/481 |

* cited by examiner

*Primary Examiner*—Mark Paschall
(74) *Attorney, Agent, or Firm*—Venable LLP; Robert Kinberg

(57) ABSTRACT

A heating system including a power supply and a heating element for conducting a current from the power supply. A temperature sensing device is adopted to detect a temperature of the heating element, and a switch is connected in a circuit containing the power supply and the heating element to switch the current on or off. Further, a microprocessor produces a pulse-width-modulated signal as a function of the detected temperature, where the pulse-width-modulated signal drives the switch.

17 Claims, 1 Drawing Sheet

MICROPROCESSOR CONTROLLED PORTABLE HEATING SYSTEM

CROSS-REFERENCE TO RELATED APPLICATIONS

This application claims the benefit of U.S. Provisional Application Ser. No. 60/379,762, filed May 14, 2002.

BACKGROUND OF THE INVENTION

The present invention relates to a portable heating system.

For small-scale heating systems, the use of nickel chromium wire, resistance coils, and other types of resistors as heating elements is well known in the art. A current is passed through these heating elements to generate heat. The more current that passes through the heating element, the more heat the heating element generates. However, heating elements in small scale heating systems are often operated well below their full capacity because of a concern for structural damage to the heating elements from overheating.

It is thus desired to provide a portable heating system that regulates the temperature of a heating element efficiently without overheating and that enables operation of the heating element at full capacity.

SUMMARY OF THE INVENTION

A portable heating system is provided. According to an exemplary embodiment, the heating system comprises a power supply, a heating element for conducting a current from the power supply, a temperature sensing device to detect a temperature of the heating element, a switch connected in a circuit containing the power supply and the heating element to switch the current on or off, and a microprocessor, connected to the switch, to produce a pulse-width-modulated signal having a pulse-width which is a function of the detected temperature. The pulse-width-modulated signal operating to open and close the switch based on the pulse-width of the signal.

DETAILED DESCRIPTION OF THE INVENTION

Figure 1:
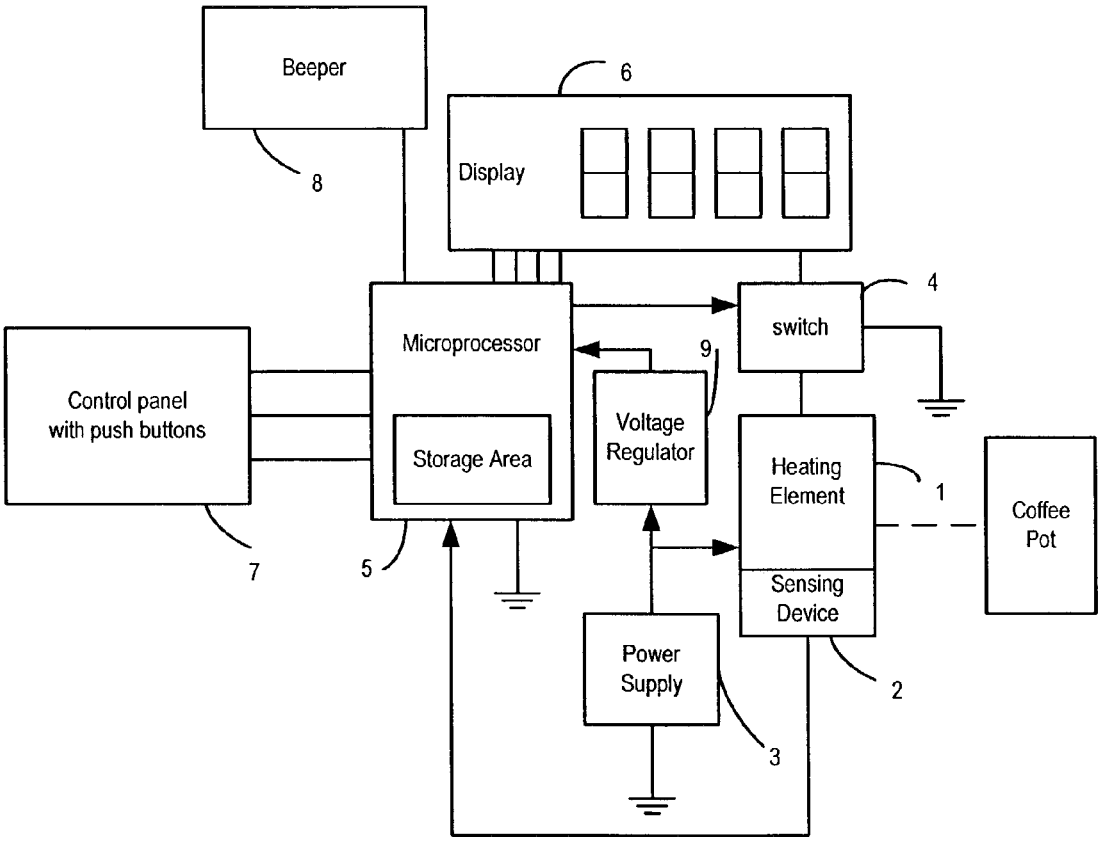
FIG. 1 is a block diagram illustrating a portable heating system according to a preferred embodiment of the invention.

FIG. 1 illustrates an exemplary portable heating system according to an embodiment of the invention. The exemplary portable heating system comprises a heating element 1, a temperature sensing device 2 arranged to detect a temperature of the heating element, a means 5 for producing a pulse-width-modulated signal, a display 6, a power supply 3, a voltage regulator 9, a control panel 7, a beeper 8 and a switch 4.

The heating element 1 is coupled between the power supply 3 and ground via the switch 4. The power supply supplies between 1–12 volts, typically about 12 volts, to the heating element. The heating element 1 can be any well-known means for heating, including a nickel chromium wire, resistance coils, and other types of resistors. By increasing or decreasing a current flow through the heating element, the temperature of the heating element 1 can be increased or decreased, respectively. The temperature sensing device 2 is thermally coupled to the heating element 1 to detect its temperature. The temperature sensing device can be any means for detecting a temperature of the heating element, e.g., a thermistor, thermometer, temperature-dependent transistor circuits, etc. The switch 4 controls the current flow through the heating element 1. The heating element 1 is coupled to ground and current flows therethrough when the switch 4 is in a conducting state. Essentially no current flows through the heating element 1 when the switch 4 is in a non-conducting state.

The means 5 for producing a pulse-width-modulated signal is coupled to the switch 4 and the temperature sensing device 2. The means 5 for producing a pulse-width-modulated signal produces a signal that switches the switch 4 between the conducting and non-conducting states. The signal is a pulse-width-modulated signal based on a currently detected temperature and optionally previously detected temperatures by the temperature sensing device 2. The means 5 for producing a pulse-width-modulated signal may include a pulse-width modulator and microprocessor. The switch 4 is coupled to the means 5 to receive the pulse-width-modulated signal. The switch 4 can be any means for selectively enabling a flow-through current, including FETs, BJTs, mechanical switches, etc.

The voltage regulator 9 is coupled to the means 5 for producing a pulse-width-modulated signal to provide power thereto. The voltage regulator 9 regulates/translates the supply voltage (e.g., 1–12 volt) from the power supply 3 to a lower voltage (e.g., 0.5–5 volt) that is required by the means 5 for producing a pulse-width-modulated signal. The voltage regulator 9 can be any means for lowering a supply voltage of the power supply, including a constant voltage generator, voltage divider, etc., that supplies the lowered voltage as an output. The power supply 3 can be any means for providing a power supply, including a battery, an AC/DC converter connected to an AC supply, and a DC plug. The DC plug can be any plug for supplying a DC voltage such as a cigarette lighter plug. The display 6, control panel 7 and beeper 8 may be coupled to the means 5 for producing a pulse-width-modulated signal.

The power supply 3 may have the same voltage as the recommended normal usage voltage for the heating element 1. Alternatively, a heating element rated for its normal usage at a voltage lower than the voltage of the power supply 3 may be used as the heating element 1. For example, the heating element 1 may be rated at 10 volt for its normal usage and the supply voltage of the power supply 3 is 12 volt. By supplying an overvoltage, the performance and efficiency of the heating element 1 can be drastically improved. Such application of an overvoltage is not normally done, however, because a constant application of the overvoltage to a heating element may drastically reduce the life span of the heating element by excessive overheating of the heating element. In an embodiment of the present invention, because the means 5 for producing a pulse-width-modulated signal stabilizes the temperature of the heating element at about the desired temperature without going over the pre-set upper and lower temperature limits, an overvoltage can be applied to the heating element 1 to fully utilize the heating element 1 without drastically reducing the life span of the heating element 1.

The operation of an exemplary portable heating system according to an embodiment of the invention is as follows. When the exemplary portable heating system first starts, the temperature sensing device 2 detects a temperature of the heating element 1 and outputs a signal indicative of the detected temperature. In response to the signal indicating the detected temperature, the means 5 for producing a pulse-width-modulated signal produces a pulse-width-modulated signal. The signal has a pulse-width that is a function of the detected temperature. Details regarding the pulse-width-modulated signal are discussed below. Previous temperatures detected by the temperature sensing device may also be taken into consideration by the means 5 for producing a pulse-width-modulated signal in producing the pulse-width-modulated signal.

The pulse-width-modulated signal is used to drive the switch 4. By switching the switch 4 between its conducting and non-conducting states, which in turn regulates the current flow current through the heating element 1, the temperature of the heating element 1 can be controlled to be within a predetermined range defined by predetermined upper and lower temperature limits. Also, the temperature of the heating element 1 can be regulated at about a desired temperature within the predetermined range. The desired temperature can be input by a user via the control panel 7 or retrieved from the storage area of the means 5 for producing a pulse-width-modulated signal. The desired temperature may be adjusted by the user or automatically by the system.

The means 5 for producing a pulse-width-modulated signal may control the operation of the digital display 6 and may also monitor the control panel 7 for user inputs. The display 6 may display a temperature of the heating element 1 detected via the temperature sensing device 2, as well as other information processed by the means 5 for producing a pulse-width-modulated signal, e.g., a current time, the pre-set upper and lower temperature limits, a power supply status, and alarm clock settings. The control panel 7 may be used to receive user inputs for controlling the exemplary portable heating system. The received user inputs may be stored in the storage area of the means 5 for producing a pulse-width-modulated signal for a subsequent usage. The control panel 7 may be used to input a current time, the pre-set upper and lower temperature limits, a desired temperature for the heating element, alarm clock settings, and other information. The control panel 7 may also be used to set an appointed time of the day when the means 5 for producing a pulse-width-modulated signal automatically provides a pulse-width-modulated signal to the heating element 1 to generate heat. The beeper 8 may receive inputs from the means 5 for producing a pulse-width-modulated signal to sound an alarm at a set time of an alarm clock setting and indicate other conditions of the heating system.

It is noted that the display 6, voltage regulator 9, control panel 7, and the beeper 8 are optional in the exemplary portable heating system and are not critical to the principal operation of the exemplary portable heating system. For instance, all information necessary for operating the portable heating system can be stored in the storage area of the means 5 for producing a pulse-width-modulated signal without having to be inputted via the control panel 7. Further, the voltage regulator 9 is not necessary if a power supply supplies an appropriate supply voltage to the means 5. It is also possible to integrate one or more individual devices, whether optional or not optional, into one device performing all of the functions of the individual devices.

Details of the pulse-width-modulation signal produced by the means 5 for producing a pulse-width-modulated signal are as follows. Generally, when the temperature of the heating element is rising, an increase in the pulse-width of the signal results in an increase of the temperature and a faster rate of temperature increase. Decreasing the pulse-width of the signal in the same situation results in a slower rate of temperature increase, and may even result in a temperature decrease. When the temperature of the heating element is declining, decreasing the pulse-width of the signal results in a decrease of the temperature and a faster rate of temperature decrease. Increasing the pulse-width in the same situation results in a slower rate of temperature decrease and may even result in a temperature increase.

The temperature of the heating element 1 can be controlled to have a certain desired rate of temperature change and a desired temperature by appropriately controlling the pulse-width of the pulse-width-modulated signal based on the above described relationships between the pulse-width of the pulse-width-modulation signal and the detected temperature of the heating element. The pulse-width is determined by the means 5 for producing a pulse-width-modulated signal based on the currently detected temperature and optionally one or more of previously detected temperatures. For instance, when the temperature of the heating element 1 is determined to be rising based on the currently detected temperature and one or more of previously detected temperatures, but is still below a desired temperature, the means 5 for producing a pulse-width-modulated signal may increase the pulse-width of the signal to increase the rate of the temperature increase and reach the desired temperature quicker. The rate of the temperature increase is controlled to be at a desired value by the means 5 for producing a pulse-width-modulated signal based on its calculations of the current rate of temperature increase and comparison of the current rate temperature increase with stored rates of temperature increase in the storage area or user inputs for rates of temperature increase. If the rate of temperature increase is determined to be adequate by the means 5 for producing a pulse-width-modulated signal based on stored data in the storage area or user inputs, the pulse-width of the signal may stay the same. If the rate temperature increase is too fast, then the means 5 for producing a pulse-width-modulated signal may decrease the pulse-width of the signal to slow the rate of rise.

Similarly, when the temperature of the heating element 1 is determined to be declining based on the currently detected temperature and one or more of previously detected temperatures, but is still above a desired temperature, then the means 5 for producing a pulse-width-modulated signal may decrease the pulse-width of the signal to increase the rate of the temperature decrease and reach the desired temperature quicker. The rate of the temperature decrease is controlled to be at a desired value by the means 5 for producing a pulse-width-modulated signal based on its calculations of the current rate of temperature decrease and comparison of the current rate of temperature decrease with stored rates of temperature decrease in the storage area or user inputs for rates of temperature decrease. If the rate of decrease in the temperature is adequate, the pulse-width may stay the same. If the rate of temperature decrease is too fast, then the means 5 for producing a pulse-width-modulated signal may increase the pulse-width of the signal to slow the rate of temperature decrease. Alternatively, depending on the magnitude of a difference between the detected temperature and the desired temperature stored in the storage area or inputted by an user, the rate of temperature change may be controlled. For instance, if the difference is large, then the rate of the temperature change may be increased to reach the desired temperature quickly. If the difference is small, then the rate of the temperature change may be decreased to prevent an overshoot of the desired temperature.

By using above discussed methods, the temperature of the heating element 1 is controlled to be about a desired temperature.

According to an exemplary portable heating system employing the invention, the portable heating system of FIG. 1 operates as a portable coffee brewer. By using the control panel 7, a user may enter a set brew time at which the heating element is to boil water for coffee. At the set brew time, the means 5 for producing a pulse-width-modulated signal produces a pulse-width-modulated signal to turn on the switch 4. The heating element 1 may be kept at a high temperature above the boiling point of water to boil water for a period of time. After coffee is made from the boiled water, the temperature of the heating element may be subsequently kept stable at a much lower temperature to keep the coffee warm. Such transition from the high temperature to the lower temperature may be controlled automatically by the means for producing a pulse-width-modulated signal without a need for further user inputs to trigger such transition. The maintenance of respective temperatures before and after the temperature transition may also be controlled automatically by the means for producing a pulse-width-modulated signal without a need for further user inputs to trigger such temperature maintenance. The heating element may have two parts so that water may be boiled by one part and a coffee pot for storing coffee already made may be kept warm by another part.

The embodiments illustrated and discussed in this specification are intended only to teach those skilled in the art the best way known to the inventors to make and use the invention. Nothing in this specification should be considered as limiting the scope of the present invention. The above-described embodiments of the invention may be modified or varied, and elements added or omitted, without departing from the invention, as appreciated by those skilled in the art in light of the above teachings. It is therefore to be understood that, within the scope of the claims and their equivalents, the invention may be practiced otherwise than as specifically described.

What is claimed is:

1. A portable heating system, comprising:

a power supply having a supply voltage;

a heating element coupled to and conducting a current from the power supply, the heating element having a rated voltage less than the supply voltage of the power supply;

a temperature sensing device adapted to detect a temperature of the heating element;

a switch coupled to the heating element to selectively enable current flow through the heating element; and a microprocessor producing a pulse-width-modulated signal having a pulse-width which is a function of the detected temperature, the pulse-width-modulated signal driving the switch such that the heating element is supplied with a voltage exceeding the rated voltage of the heating element and the temperature of the heating element is maintained below an upper limit.

2. The system of claim 1, wherein the microprocessor controls the switch so that the temperature of the heating element is kept at a temperature above a boiling point of water for a period of time and automatically transitions to a temperature much lower than the boiling point of water.

3. The system of claim 2, further comprising a control panel receiving user inputs and providing the user inputs to the microprocessor.

4. The system of claim 3, wherein the microprocessor controls the switch to turn on at a certain set time of the day as set by an user input.

5. The system of claim 1, further comprising a voltage regulator to lower a supply voltage of the power supply and provide the lower voltage to the microprocessor.

6. The system of claim 2, further comprising a pot thermally connected to the heating element.

7. A portable heating system, comprising:

means for providing a power supply at a supply voltage;

means for heating by conducting a current from the power supply, the means for heating having a rated voltage less than the supply voltage;

means for detecting a temperature of the heating means;

means for selectively enabling current flow through the heating means; and means for producing a pulse-width-modulated signal having a pulse-width which is a function of the detected temperature, the pulse-width-modulated signal driving the selectively enabling means such that the heating element is supplied with a voltage exceeding the rated voltage of the heating element and the temperature of the heating element is maintained below an upper limit.

8. The system of claim 7, wherein the means for producing a pulse-width-modulated signal controls the selectively enabling means so that the temperature of the heating means is kept at a temperature above a boiling point of water for a period of time and automatically transitions to a temperature much lower than the boiling point of water.

9. The system of claim 8, further comprising a control panel receiving user inputs and providing the user inputs to the means for producing a pulse-width-modulated signal.

10. The system of claim 9, wherein the means for producing a pulse-width-modulated signal controls the switching means to turn on at a certain set time of the day as set by an user input.

11. The system of claim 7, further comprising means for lowering a supply voltage of the power supply and providing the lower voltage to the producing means.

12. The system of claim 8, further comprising a means for containing liquid, where the heating means controls a temperature of the liquid.

13. A method of portable heating, comprising:

providing a power supply having a supply voltage;

heating a heating element having a rated voltage less than the supply voltage by conducting a current from the power supply;

detecting a temperature of the heating element;

selectively enabling current flow through the heating element with a switching element; and producing a pulse-width-modulated signal having a pulse-width which is a function of the detected temperature, the pulse-width-modulated signal driving the switching element such that the heating element is supplied with a voltage exceeding the rated voltage of the heating element and the temperature of the heating element is maintained below an upper limit.

14. The method of claim 13, wherein the heating of the heating element comprises keeping the temperature of the heating element at a temperature above a boiling point of water for a period of time and automatically transitions the temperature to a temperature much lower than the boiling point of water.

15. The method of claim 14, wherein the producing of the pulse-width-modulated signal comprises receiving user inputs at a control panel and controlling the heating element to turn on at a certain set time of the day as set by an user input.

16. The method of claim 13, further comprising lowering a supply voltage of the power supply for producing of the pulse-width-modulated signal.

17. The method of claim 14, further comprising controlling a temperature of liquid coffee with the heating element.

* * * * *